US005219380A

United States Patent [19]

Young et al.

[11] Patent Number: 5,219,380

[45] Date of Patent: Jun. 15, 1993

[54] TRENCHING APPARATUS

[75] Inventors: Paul Young, West Bend, Wis.; Richard A. Ryerson, Pella, Iowa

[73] Assignee: Vermeer Manufacturing Company, Pella, Iowa

[21] Appl. No.: 859,348

[22] Filed: Mar. 27, 1992

[51] Int. Cl.[5] ..... E02F 3/12

[52] U.S. Cl. ..... 37/359; 37/96; 37/97; 37/192 A; 198/315

[58] Field of Search ..... 37/89, 90, 93, 95, 96, 37/97, 101, 102, 110, 190, 192 R, 192 A; 198/304, 312, 315

[56] References Cited

U.S. PATENT DOCUMENTS

| | | | |
|---|---|---|---|
| 906,655 | 12/1908 | Parsons | 37/90 |
| 1,210,453 | 1/1917 | French | 37/90 |
| 3,043,035 | 7/1962 | Fogelberg | 37/190 |
| 3,896,571 | 7/1975 | Satterwhite | 37/190 |
| 3,982,340 | 9/1976 | Satterwhite | 37/190 |
| 4,003,148 | 1/1977 | Satterwhite | 37/190 |
| 4,157,623 | 6/1979 | Satterwhite | 37/190 |
| 4,167,826 | 9/1979 | Feliz | 37/190 |
| 5,058,657 | 10/1992 | Bryan | 37/189 X |
| 5,092,294 | 3/1992 | Bryan | 37/189 X |

*Primary Examiner*—Randolph A. Reese
*Assistant Examiner*—Arlen L. Olsen
*Attorney, Agent, or Firm*—Kent A. Herink; Brian J. Laurenzo

[57] ABSTRACT

A trenching machine having a tractor unit and a trenching bar mounted for transverse sliding movement on the rear end portion of the tractor unit to any desired location within the transverse confines of the tractor unit. Spoil generated by the trenching bar is deposited on either of a pair of transverse conveyors which are operable either to transport spoil transversely outwardly to the side of the trenching machine or transversely inwardly to a central hopper. A longitudinal conveyor located on the center line of the trencher extends from a low position at the rear-end portion of the tractor unit at the bottom of the hopper forwardly and upwardly to a high position forwardly of the tractor unit. A swinging conveyor is mounted for pivotal movement about both a vertical and horizontal axis forwardly of the tractor unit and below the output of the longitudinal conveyor. Spoil transported on the longitudinal conveyor is deposited on the swinging conveyor which transports it for deposit outside the transverse confines or forwardly of the tractor unit.

4 Claims, 5 Drawing Sheets

TRENCHING APPARATUS

BACKGROUND OF THE INVENTION

The invention relates generally to trenching machines and, more specifically, to a trenching machine having a trenching bar mounted for sliding transverse movement at the rear end portion of the trenching machine and including a plurality of conveyors for transporting spoil from the trenching bar centrally, and upwardly and forwardly for deposit outside of the transverse confines or forwardly of the trenching machine.

Trenching machines are widely used for creating narrow trenches in a variety of subsurface conditions and locations. A common use of such trenches is in the installation of service lines such as electrical cable, water pipes, sewer lines and the like. It is frequently desired or necessary to have the trenches run close to existing structures or objects such as buildings, roadways, and trees. For this purpose, offset trenching machines have been developed wherein the trenching bar is mounted for sliding movement at the rear end portion of the trenching machine to be operable for creating trenches at any desired location within the range of sliding movement of the trenching bar.

In the operation of such machines, as with all trenching machines, spoil is created which is either deposited at the trenching site for backfilling of the trench or other purposes, or loaded onto a truck or similar device for transport to a remote location. Because an offset trenching machine will create spoil that will ordinarily be deposited by the trenching bar at any location within the range of transverse movement of the trenching bar, a conveying system is required that can accommodate the range of positions of the trenching bar. Moreover, it is desired that the conveying system be adaptable to convey and deposit the spoil in a variety of locations to increase the effective use of the offset trenching machine in proximity to buildings and other objects as described above.

SUMMARY OF THE INVENTION

The invention consists of a trenching machine having a tractor unit on the rear end portion of which is mounted a trenching bar which is slidably movable for trenching at any desired position generally within the transverse confines of the tractor unit. Spoil generated by the trenching bar is carried thereby upwardly and forwardly and deposited on the rear end portion of the trenching machine at a location that is dependent upon the transverse position of the trenching bar. A pair of reversible transverse conveyors are mounted one each on either side of the longitudinal centerline of the trenching machine. Spoil from the trenching bar is deposited on the corresponding one of the transverse conveyors. If the spoil is to be deposited on the ground adjacent to the trenching machine, the appropriate transverse conveyor is operated to transport the spoil transversely outwardly of the trenching machine. If the spoil is to be conveyed for deposit on a truck or other transport device, the transverse conveyors are operated to transport the spoil transversely inwardly for deposit on a longitudinal conveyor located centrally of the trenching machine. The longitudinal conveyor extends from a lower position between the pair of transverse conveyors upwardly and forwardly to a high position forwardly of the tractor unit. Spoil transported on the longitudinal conveyor is deposited on a swinging conveyor that is mounted on the front end portion of the tractor unit for pivotable movement to either side and forwardly of the tractor unit. Spoil deposited on the swinging conveyor from the longitudinal conveyor is transported thereon and deposited outside the transverse confines or forwardly of the tractor unit.

An object of the present invention is to provide a conveying system for an offset trenching machine by which spoil may be deposited at a plurality of locations.

Another object of the invention is to provide a conveying system for an offset trenching machine whereby spoil generated by a trenching bar offset from the centerline of the trenching machine may be transported and deposited adjacent the side of the trenching machine near which the trenching bar is operating.

A further object of the invention is to provide a conveying system wherein spoil generated by a trenching bar offset from the longitudinal centerline of the trenching machine is transported centrally of the trenching machine for subsequent transport.

Still another object of the invention is to provide a trenching machine having a conveyor system wherein spoil generated by a trenching bar offset from the longitudinal centerline of the trenching machine is conveyed inwardly toward a longitudinal conveyor for conveyance upwardly and forwardly for deposit on a swinging conveyor for subsequent transport of the spoil outside the transverse confines or forwardly of a tractor unit of the trenching machine.

Still a further object of the invention is to provide an offset trenching machine which includes a self-contained conveyor system for the deposit of spoil directly onto a truck or other transport device and which may be positioned within the transverse confines of the tractor unit during transport of the trenching machine.

These and other objects of the invention will become clear upon a review and understanding of the specification and drawings.

DETAILED DESCRIPTION OF A PREFERRED EMBODIMENT

Figure 1:
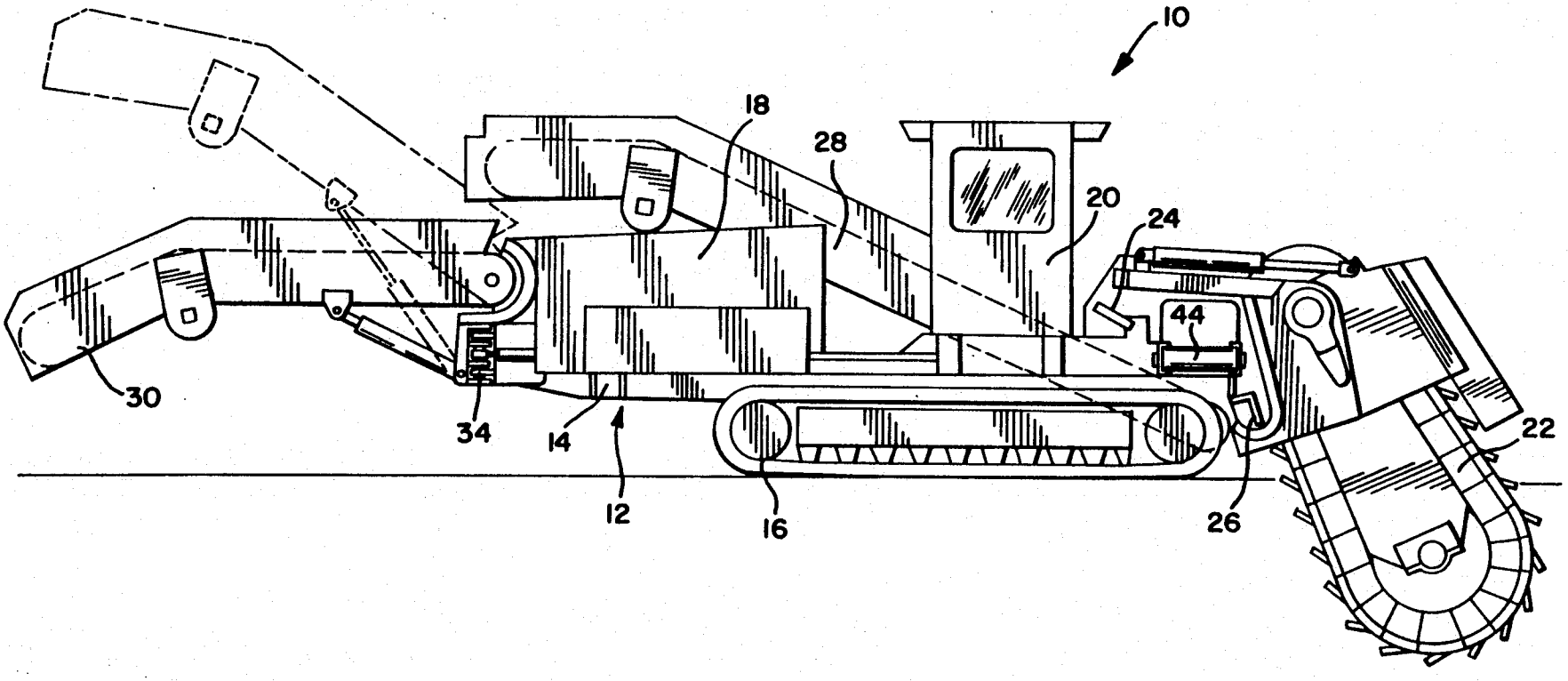
FIG. 1 is a side view of the ground-supported trenching machine of the present invention showing a swinging conveyor located at the front-end portion of the machine moveable between a low position and a high position.

Illustrated in FIG. 1, generally a 10, is trenching machine which includes a tractor unit 12 having a main frame 14 supported on endless tracks 16 and serving as a platform for an engine 18 and operator cab 20. A trenching bar 22 is mounted on the frame 14 at the rear end portion of the tractor unit 12. The trenching bar 22 is slidably moveable on a pair of pads 24 and 26 (FIGS. 1–3) to any desired position within the transverse confines of the tractor unit 12.

A longitudinal conveyor 28 is located centrally of the trenching machine 10 and extends from a low position at the rear end portion of the tractor unit upwardly and forwardly to a high position forwardly of the tractor unit 12. The engine 18 is located sufficiently forwardly on the main frame 14 of the tractor unit 12 to serve both as a counterbalance for the weight of and forces generated by the trenching bar 22 and to provide clearance for the longitudinal conveyor 28.

Figure 2:
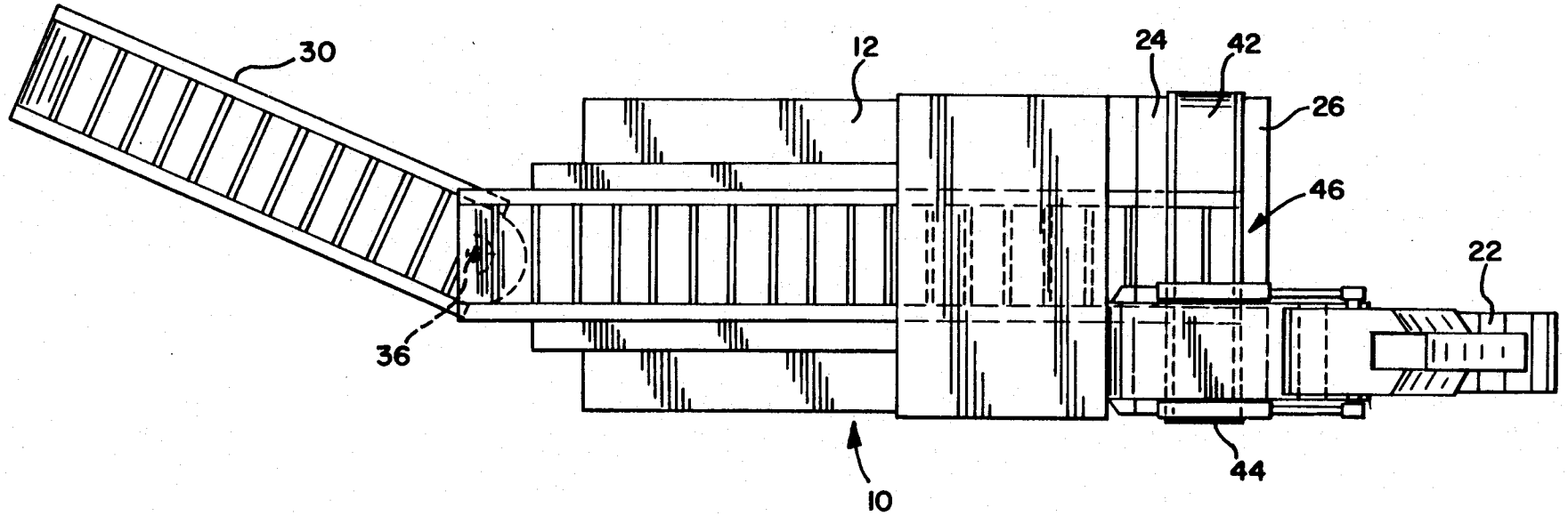
FIG. 2 is an upper plan view of the trenching machine showing the offset trenching bar moved to a first side of the trenching machine and the swinging conveyor pivoted to the opposite side thereof.
Figure 3:
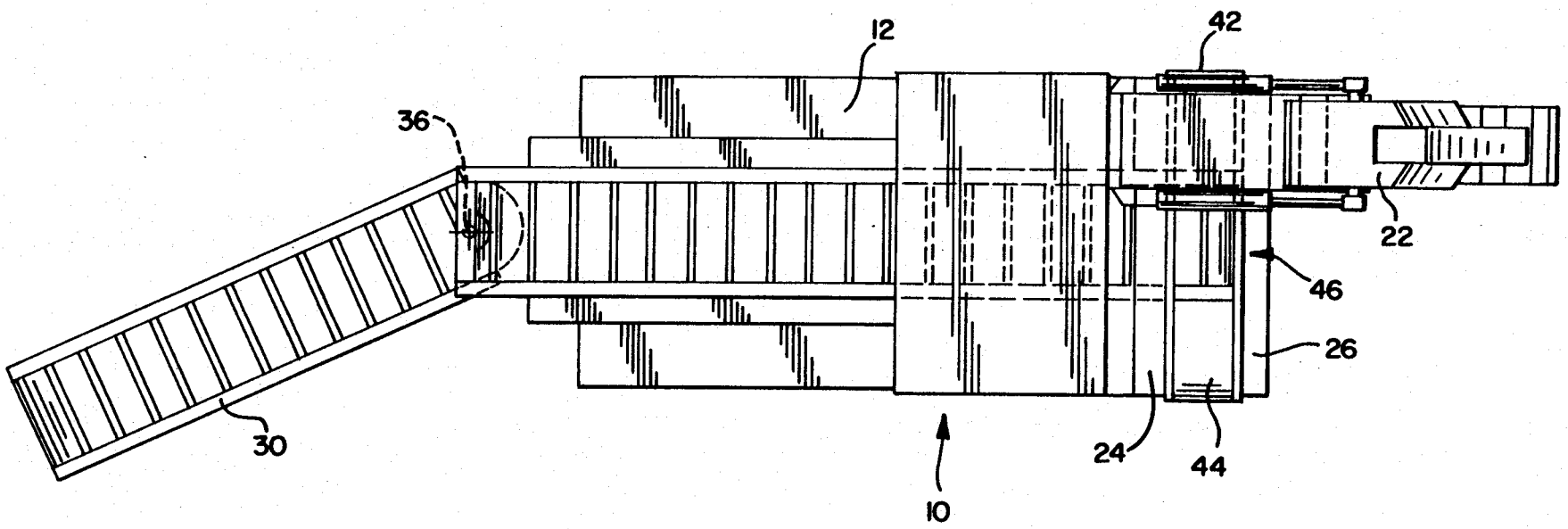
FIG. 3 is an upper plan view of the trenching machine showing the offset trenching bar moved to a second side of the trenching machine and the swinging conveyor pivoted to the opposite side thereof.
Figure 4:
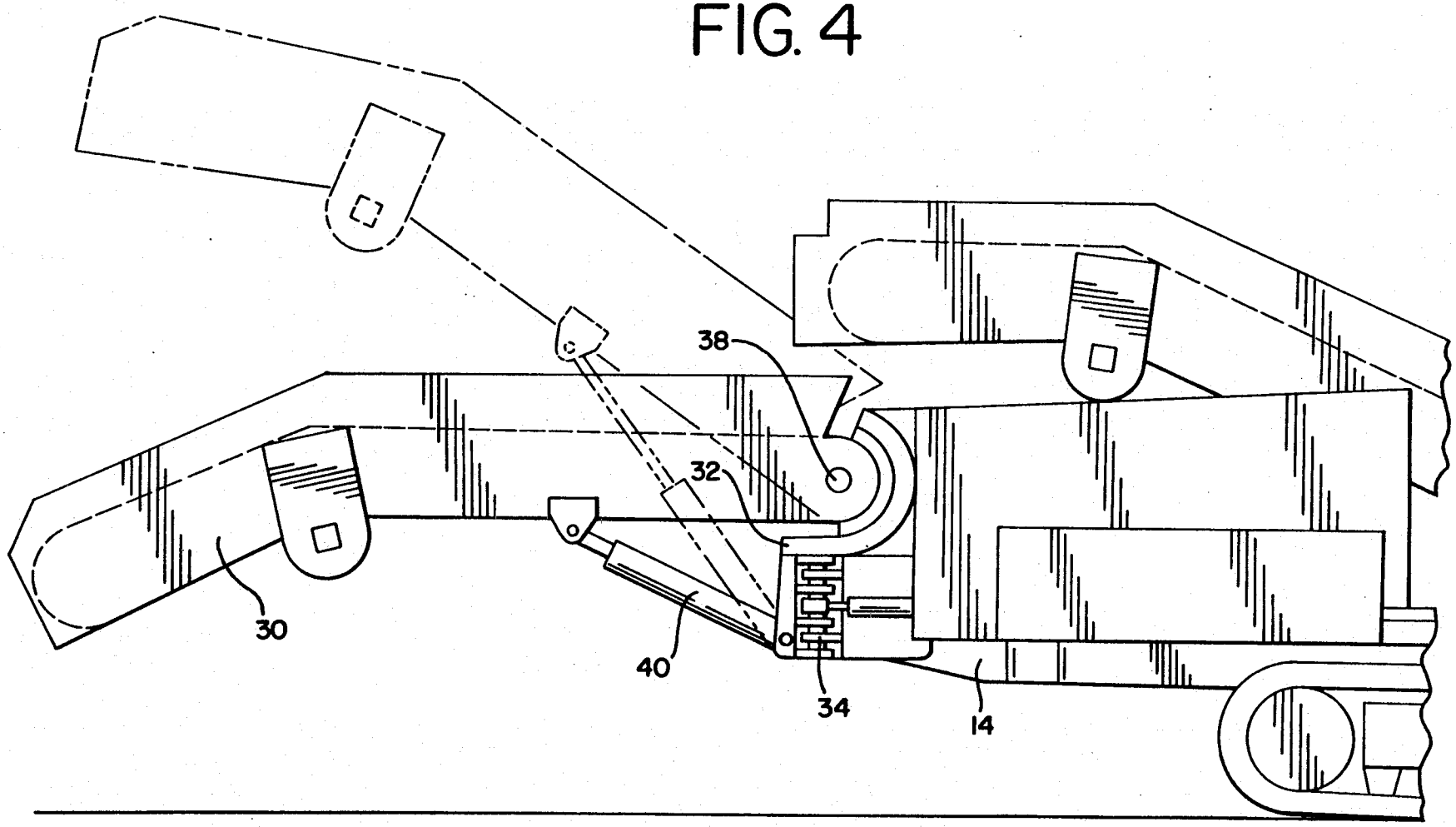
FIG. 4 is an enlarged detail view of the front-end portion of the trenching machine showing the mounting of the swinging conveyor for pivotal movement about two axes relative to the front-end portion of the trenching machine.

A swinging conveyor 30 is mounted at the front-end portion of the tractor unit for pivotal movement about both a vertical axis and horizontal axis. As best illustrated in FIG. 4, a support frame 32 of the swinging conveyor 30 is interconnected to the main frame 14 by a multi-layered hinged joint 34 which has a vertical pivot axis at 36 (FIGS. 2 and 3). The swinging conveyor 30 is thus pivotable about the vertical axis 36 to either side of the trenching machine 10 as illustrated in FIGS. 2 and 3. The swinging conveyor 30 is supported on the frame 32 for pivotal movement about a horizontal axis at 38 between a low position illustrated in FIG. 4 in solid line and a high position illustrated in FIG. 4 in broken line. A hydraulic cylinder 40 interconnects the swinging conveyor to the support frame 32 at points remote from the horizontal axis 38 and the extension and retraction of which raises and lowers the swinging conveyor 30, respectively.

Figure 5:
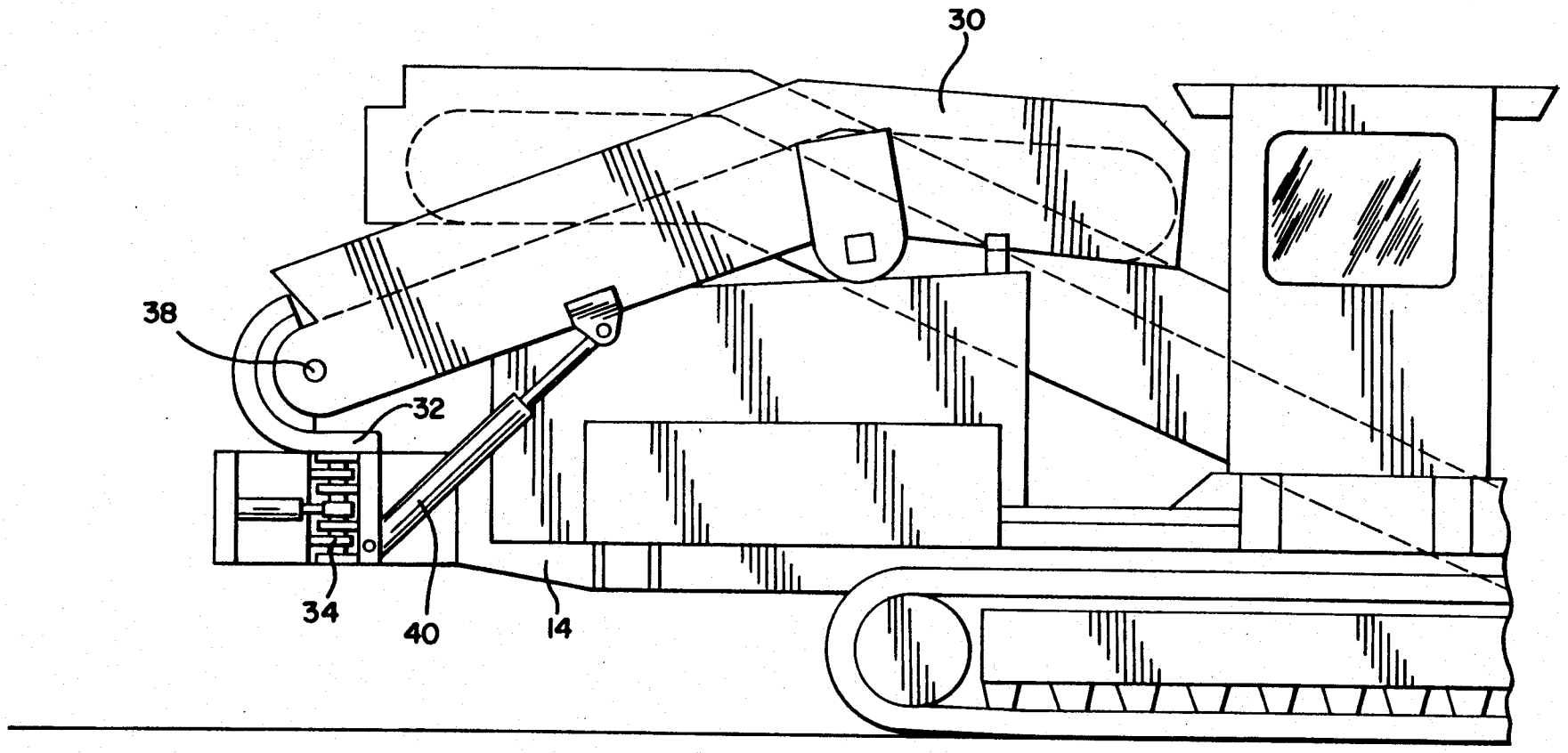
FIG. 5 is an enlarged side view of the trenching machine showing the swinging conveyor in a storage position therefor.

The swinging conveyor 30 may be moved to a storage or transport position (FIG. 5) by pivotal movement thereof on a hinge assembly 48 (FIGS. 4 and 5) having a vertical pivot axis located to the left of the longitudinal centerline of the trenching machine 12. The hinge assembly 48 also serves as the support for the multi-layered hinge joint 34 and the hydraulic cylinder 40 which, accordingly, pivot on the hinge assembly 48 as the swinging conveyor is moved to the storage position. In the storage position, the swinging conveyor 30 rests on a support 50 mounted on the main frame 14 and 15 held the transverse and substantially inside the longitudinal confines of the tractor unit 12.

The trenching machine also includes a pair of substantially horizontal, transverse conveyors 42 (FIG. 2) and 44 (FIG. 3). As described above, the trenching bar 22 can be positioned at any desired location along its range of travel on the pads 24 and 26 generally within the transverse confines of the tractor unit 12. In FIG. 2, the trenching bar 22 is illustrated in a position to the left of the longitudinal centerline of the trenching machine 10. In this position, spoil generated by operation of the trenching bar 22 will be carried upwardly and forwardly thereby and deposited on the transverse conveyor 44. The transverse conveyors 42 and 44 may be operated in either direction. If, in reference to FIG. 2, the transverse conveyor 44 is operated to transport spoil transversely outwardly, the spoil will be expelled from the conveyor 44 and deposited on the ground adjacent the left side of the trenching machine 10. Deposit of the spoil closely adjacent to the trenching machine may be desirable when the spoil is to be used to backfill the trench. Alternatively, it may be desired to transport the spoil for deposit at a location remote from the trenching machine 10. In this instance, the transverse conveyor 44 is operated in a reverse direction to transport spoil transversely inwardly. Spoil expelled from the transverse conveyor 44 will be deposited in a hopper 46 which surrounds the lower, rearward portion of the longitudinal conveyor 28. Operation of the longitudinal conveyor 28 will transport the spoil forwardly and upwardly where it will be expelled onto the swinging conveyor 30.

In a like manner, referring to FIG. 3, the transverse conveyor 42 may be operated either to deposit spoil closely adjacent to the right side of the trenching machine 10 or to expel material into the hopper 46 for subsequent conveyance by the longitudinal conveyor 28 and swinging conveyor 30.

The swinging conveyor 30 can be used to deposit spoil on the ground at a location more remote from the trenching machine than can be accomplished with the transverse conveyors 42 and 44. The swinging conveyor 30 can also be used to raise the spoil sufficiently high for direct deposit onto a truck or other device for transportation to a remote location. The pivotal motion of the swinging conveyor 30 about both a vertical and horizontal axis provides a wide range of movement of the swinging conveyor 30. Such flexibility enhances the effective performance of the trenching machine by permitting trenching close to an obstruction and the delivery of spoil to a wide variety of locations.

Although the invention has been described with respect to a preferred embodiment thereof, it is to be also understood that it is not to be so limited since changes and modifications can be made therein which are within the full intended scope of this invention as defined by the appended claims.

I claim:

1. In a trenching machine suitable for highway transport having a cab and an engine of the type wherein a trenching bar is mounted on a rear end portion of a tractor unit for transverse sliding movement between transverse confines of the trenching machine, the improvement comprising:

(a) a pair of transverse conveyors located below and on either side of a central output position of the trenching bar;

(b) a central, longitudinal conveyor extending from a position below and between said transverse conveyors forwardly underneath the cab and above the engine to an output position;

(c) a swinging conveyor mounted at the forward end of said tractor unit and having an input end positioned below said output position of said central conveyor;

(d) means for pivoting said swinging conveyor between an operating position and a transport position within the transverse and substantially within the longitudinal confines of the tractor unit; and (e) whereby spoil generated by said trenching bar is deposited on one of said transverse conveyors which conveys said spoil centrally of the tractor unit and for deposit on said longitudinal conveyor, which conveys said spoil upwardly and forwardly.

2. A trenching machine as defined in claim 1, wherein said transverse conveyors are reversible for conveying said spoil transversely outwardly for deposit to a corresponding side of the tractor unit.

3. A trenching machine as defined in claim 1, further comprising a swinging conveyor mounted at the forward end portion of said tractor unit for pivotal movement to either side and forwardly of said tractor unit and wherein spoil is deposited by said longitudinal conveyor onto said swinging conveyor.

4. A trenching machine as defined in claim 3, wherein said swinging conveyor is pivotable about a horizontal axis between a raised position and a lowered position.

* * * * *